US008902012B2

(12) United States Patent
Kroening

(10) Patent No.: US 8,902,012 B2
(45) Date of Patent: Dec. 2, 2014

(54) WAVEGUIDE CIRCULATOR WITH TAPERED IMPEDANCE MATCHING COMPONENT

(75) Inventor: Adam M. Kroening, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 182 days.

(21) Appl. No.: 13/588,374

(22) Filed: Aug. 17, 2012

(65) Prior Publication Data

US 2014/0049334 A1 Feb. 20, 2014

(51) Int. Cl.
*H01P 1/39* (2006.01)

(52) U.S. Cl.
CPC ..... *H01P 1/39* (2013.01)
USPC ..... 333/1.1

(58) Field of Classification Search
USPC ..... 333/1.1, 24.2
See application file for complete search history.

(56) References Cited

U.S. PATENT DOCUMENTS

| | | | |
|---|---|---|---|
| 3,070,760 | A | 12/1962 | Wheeler |
| 3,341,789 | A | 9/1967 | Goodman et al. |
| 3,935,548 | A | 1/1976 | Rosenbaum et al. |
| 4,058,780 | A | 11/1977 | Riblet |
| 4,309,666 | A | 1/1982 | Ito et al. |
| 4,604,590 | A | 8/1986 | Mlinar et al. |
| 4,697,158 | A | 9/1987 | Hoover et al. |
| 5,473,294 | A | 12/1995 | Mizzoni et al. |
| 6,292,068 | B1 | 9/2001 | Martin |
| 6,885,257 | B2 | 4/2005 | Kroening |
| 7,242,263 | B2 | 7/2007 | Kroening |
| 7,561,003 | B2 | 7/2009 | Kroening |
| 2003/0107447 | A1 | 6/2003 | Kroening |
| 2004/0119550 | A1 | 6/2004 | Trammell et al. |
| 2005/0179504 | A1 | 8/2005 | Kroening |
| 2006/0232353 | A1 | 10/2006 | Kroeing |
| 2006/0250195 | A1 | 11/2006 | Kroening |
| 2006/0261909 | A1 | 11/2006 | Kroening |

(Continued)

FOREIGN PATENT DOCUMENTS

| | | |
|---|---|---|
| DE | 3026257 | 2/1982 |
| EP | 0239210 | 9/1987 |

(Continued)

OTHER PUBLICATIONS

European Patent Office, "Office Action from EP Application No. 13179326.7 mailed on Jan. 3, 2014", "from Foreign Counterpart of U.S. Appl. No. 13/588,374", Jan. 3, 2014, pp. 1-5, Published in: EP.

(Continued)

*Primary Examiner* — Stephen Jones
(74) *Attorney, Agent, or Firm* — Fogg & Powers LLC

(57) ABSTRACT

Systems and methods for a waveguide circulator with tapered matching component are provided. In certain embodiments, a waveguide structure comprises a plurality of waveguide arms; an internal cavity; a plurality of tapered matching components, wherein each tapered matching component in the plurality of tapered matching components has a narrow taper end that is connected to the internal cavity and a wide taper end that is connected to a waveguide arm in the plurality of waveguide arms, wherein the narrow taper end is narrower than the wide taper end; and a ferrite element having ferrite element segments disposed in the internal cavity, wherein a segment extends through the narrow taper end and the narrow taper end of the tapered matching component is narrower than the wide taper end such that a magnitude of impedance difference between each waveguide arm and the internal cavity containing the ferrite element is reduced.

19 Claims, 9 Drawing Sheets

(56) References Cited

U.S. PATENT DOCUMENTS

| | | | |
|---|---|---|---|
| 2009/0108953 | A1 | 4/2009 | Kroening |
| 2010/0109791 | A1 | 5/2010 | Lingel |
| 2014/0049332 | A1 | 2/2014 | Kroening |
| 2014/0049333 | A1 | 2/2014 | Kroening |
| 2014/0049335 | A1 | 2/2014 | Kroening |

FOREIGN PATENT DOCUMENTS

| | | |
|---|---|---|
| JP | 51117853 | 10/1976 |
| JP | 52152145 | 12/1977 |
| SU | 1256109 | 9/1986 |
| WO | 8806807 | 9/1988 |

OTHER PUBLICATIONS

European Patent Office, "Office Action", "from Foreign Counterpart of U.S. Appl. No. 13/588,314", Dec. 16, 2013, pp. 1-9, Published in: EP.

European Patent Office, "European Search Report", "from Foreign Counterpart of U.S. Appl. No. 13/588,314", Dec. 3, 2013, pp. 1-5, Published in: EP.

European Patent Office, "Office Action", "from Foreign Counterpart of U.S. Appl. No. 13/588,337", Dec. 9, 2013, pp. 1-6, Published in: EP.

European Patent Office, "European Search Report", "from Foreign Counterpart of U.S. Appl. No. 13/588,337", Nov. 26, 2013, pp. 1-4, Published in: EP.

European Patent Office, "European Search Report", "from Foreign Counterpart of U.S. Appl. No. 13/588,374", Dec. 9, 2013, pp. 1-3, Published in: EP.

Billings et al., "Ferrite Circulator Switches and Their Applications", Nov. 2003, pp. 1-2.

Joubert, "Design of Unequal H-Plane Waveguide Power Dividers for Array Applications", Feb. 1997, pp. 1-6.

Liang et al., "A Rigorous Three Plane Mode-Matching Technique for Characterizing Waveguide T-Junctions, and its Application in Multiple", Dec. 12, 1991, pp. 2138-2147.

Lin Lin, "Theory and Design of Ferrite Latching Waveguide Junction Circulators", Dec. 1987, pp. 1-3.

Pozar, "10.6 Ferrite Circulators", Feb. 2004, pp. 1-4.

U.S. Patent and Trademark Office, "Notice of Allowance", "from U.S. Appl. No. 13/588,314", Jul. 15, 2014, pp. 1-9, Published in: US.

U.S. Patent and Trademark Office, "Office Action", "from U.S. Appl. No. 13/588,314", Apr. 10, 2014, pp. 1-25, Published in: US.

U.S. Patent and Trademark Office, "Final Office Action", "from U.S. Appl. No. 13/588,337", Jul. 15, 2014, pp. 1-14, Published in: US.

U.S. Patent and Trademark Office, "Office Action", "from U.S. Appl. No. 13/588,337", Mar. 25, 2014, pp. 1-20, Published in: US.

U.S. Patent and Trademark Office, "Notice of Allowance", "from U.S. Appl. No. 13/588,418", Mar. 26, 2014, pp. 1-22, Published in: US.

WAVEGUIDE CIRCULATOR WITH TAPERED IMPEDANCE MATCHING COMPONENT

BACKGROUND

Circulators have a wide variety of uses in commercial and military, space and terrestrial, and low and high power applications. A waveguide circulator may be implemented in a variety of applications, including but not limited to low noise amplifier (LNA) redundancy switches, T/R modules, isolators for high power sources, and switch matrices. One important application for such waveguide circulators is in space, for example, in satellites, where reliability is essential and where size and weight are important. Circulators made from a ferrite material are desirable for these applications due to their high reliability due to their lack of moving parts, which moving parts could wear down over time. However, the bandwidth of ferrite circulators is limited, which affects the ability of a single circulator to function over a broadband of frequencies For the reasons stated above and for other reasons stated below which will become apparent to those skilled in the art upon reading and understanding the specification, there is a need in the art for an impedance matched ferrite circulator with improved bandwidth.

SUMMARY

The embodiments of the present disclosure provide a waveguide circulator with reduced width in a ferrite or ferrite element region and will be understood by reading and studying the following specification.

Systems and methods for a waveguide circulator with tapered matching component are provided. In certain embodiments, a waveguide structure comprises a plurality of waveguide arms; an internal cavity; a plurality of tapered matching components, wherein each tapered matching component in the plurality of tapered matching components has a narrow taper end that is connected to the internal cavity and a wide taper end that is connected to a waveguide arm in the plurality of waveguide arms, wherein the narrow taper end is narrower than the wide taper end; and a ferrite element having a plurality of ferrite element segments disposed in the internal cavity, wherein a segment in the plurality of ferrite element segments extends through the narrow taper end of the tapered matching component and the narrow taper end of the tapered matching component is narrower than the wide taper end such that a magnitude of impedance difference between each waveguide arm and the internal cavity containing the ferrite element is reduced.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize features relevant to the present invention. Reference characters denote like elements throughout figures and text.

DETAILED DESCRIPTION

Figure 1:
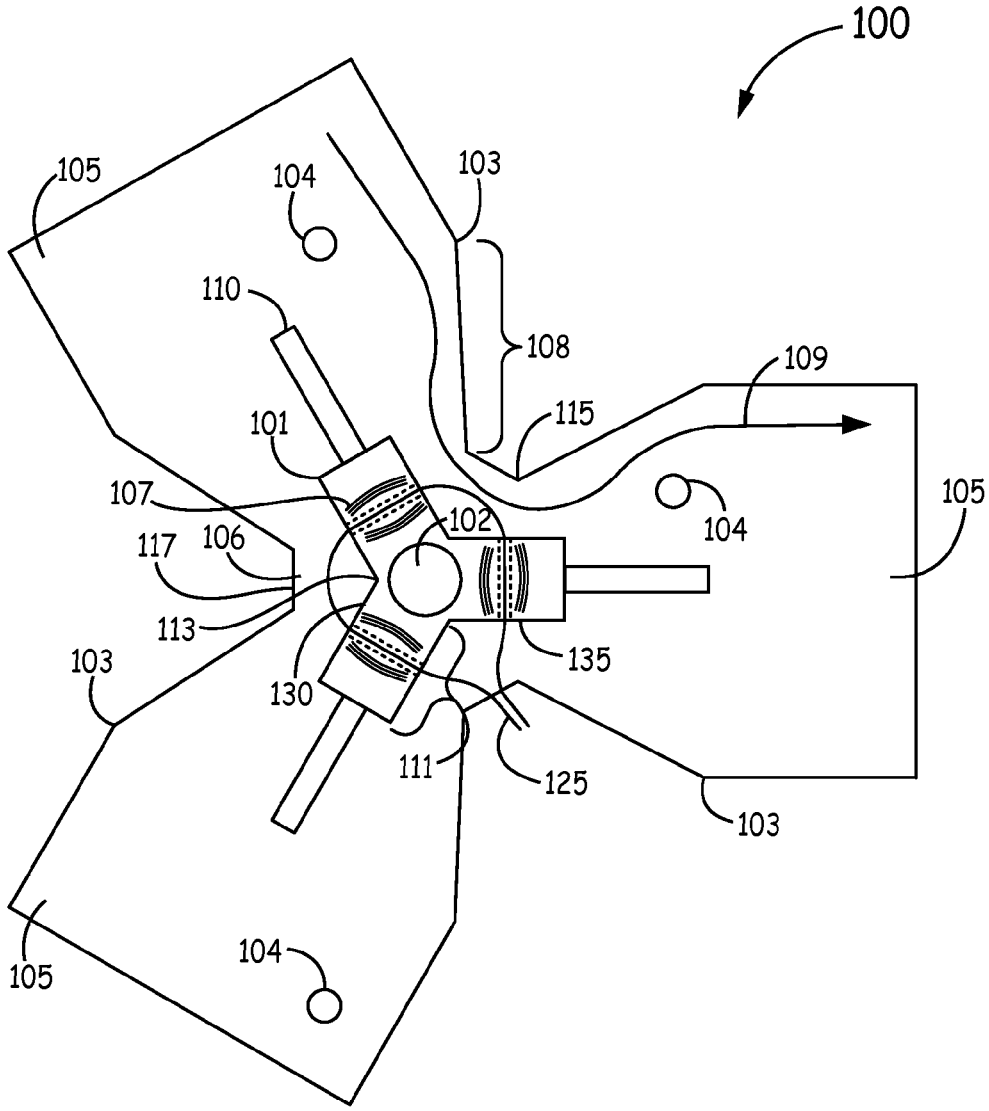
FIG. 1 is a block diagram illustrating a top view of a waveguide circulator according to one embodiment.

In the following detailed description, reference is made to the accompanying drawings that form a part hereof, and in which is shown by way of illustrating specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

As described below in detail, the present disclosure describes various embodiments for improved impedance matching of the ferrite element to the air-filled waveguide in a waveguide circulator, while improving the bandwidth of the waveguide circulator. To impedance match the air-filled waveguide to the ferrite element within the waveguide circulator, the width of the waveguide is narrowed in the region of the waveguide around the ferrite element such that the difference between the impedance of the combination of the narrowed region and the ferrite element and the impedance of the air-filled waveguide is reduced. Also, a transformer or a ferrite element with specific properties is used to match the impedance between the waveguide circulator and the air-filled waveguide. The waveguide can narrow gradually over the length of the ferrite element or narrow through at least one step around the ferrite element to impedance match the ferrite element to the air-filled waveguide. Reducing the impedance mismatch between the combination of the ferrite element and the narrowed region and the air-filled waveguide improves the frequency bandwidth of the ferrite circulator without impacting size, mass, or cost.

FIG. 1 is a top view of a waveguide circulator structure 100 according to one embodiment described in the present disclosure. Waveguide circulator structure 100 connects to waveguide arms 105. Waveguide arms 105 are waveguides that extend from waveguide circulator structure 100, where the waveguide arms 105 convey microwave energy to and from waveguide circulator structure 100. In at least one embodiment, a tapered matching component 108 connects waveguide arms 105 to waveguide circulator structure 100. In certain implementations, waveguide circulator structure 100 is a y-shaped waveguide arm junction that connects to three waveguide arms 105 that each extend away from an associated tapered matching component 108. Also, in some implementations, the longitudinal axes of waveguide arms 105 are arranged in an RF H-plane of the waveguide circulator structure 100, where the waveguide arms are arranged in the H-plane of the waveguide circulator structure 100 at intervals of 120 degrees.

In certain embodiments, waveguide circulator structure 100 includes an internal cavity 106 that encloses a ferrite element 101. Ferrite element 101 is made from a non-reciprocal material such as a ferrite, where the non-reciprocal material is such that the relationship between an oscillating current and the resulting electric field changes if the location where the current is placed and where the field is measured changes. Magnetic fields 107 created in ferrite element 101, can be used to circulate a microwave signal 109 from propagating in one waveguide arm 105 to propagate in another waveguide arm 105 connected to the waveguide circulator structure 100. The reversing of the direction of the magnetic field 107 reverses the direction of circulation within ferrite element 101. The reversing of the direction of circulation within ferrite element 101 also switches which waveguide arm 105 propagates the signal away from ferrite element 101. In at least one exemplary embodiment, a waveguide circulator structure 100 is connected to three waveguide arms 105, where one of waveguide arms 105 functions as an input arm and two waveguide arms 105 function as output arms. The input waveguide arm 105 propagates microwave signal 109 into waveguide circulator structure 100, where the waveguide circulator structure 100 circulates microwave signal 109 through ferrite element 101 and out one of the two output waveguide arms 105. When the magnetic fields 107 are changed, the microwave signal 109 is circulated through ferrite element 101 and out the other of the two output waveguide arms 105. Thus, a ferrite element 101 has a selectable direction of circulation. A microwave signal 109, received from an input waveguide arm 105 can be routed with a low insertion loss from the one waveguide arm 105 to either of the other output waveguide arms 105.

In certain implementations, segments 111 of ferrite element 101 protrude into separate waveguide arms 105. For example, ferrite element 101 can be a Y-shaped ferrite element 101. However, ferrite element 101 can be other shapes as well, such as a triangular puck, a cylinder, and the like. In at least one implementation, ferrite element 101 is a switchable or latchable ferrite circulator as opposed to a fixed bias ferrite circulator, where a latchable ferrite circulator is a circulator where the direction of circulation can be latched in a certain direction. To make ferrite element 101 switchable, a magnetizing winding 125 is threaded through apertures 135 in the segments 111 of ferrite element 101 that protrude towards separate waveguide arms 105. These apertures 135 are created by boring a hole through a portion of ferrite element 101 that protrudes into each separate waveguide arm 105. Magnetizing winding 125 is threaded through apertures 135. Currents passed through magnetizing winding 125 control and establish a magnetic field 107 in ferrite element 101 where a portion of the magnetic field is not parallel to the H-plane. The polarity of magnetic field 107 can be switched by the application of current on magnetizing winding 125 to create a switchable circulator. The portion of ferrite element 101 where the segments 111 of the ferrite element 111 converge and to the inside of the three apertures 135 is referred to as a resonant section 130 of ferrite element 101. The dimensions of the resonant section 130 determine the operating frequency for circulation in accordance with conventional design and theory. The three protruding segments 111, or legs of ferrite element 101 towards the outside of the magnetizing winding apertures 135 act both as return paths for the bias fields in resonant section 130 and as impedance transformers out of resonant section 130.

In certain implementations, a quarter wave dielectric transformer 110 is attached to the end of segments of ferrite element 101 that are farthest away from the middle of the ferrite element 101. The quarter wave dielectric transformers 110 aid in the transition from a ferrite element 101 to an air-filled waveguide arm 105. Dielectric transformers 110 can match the lower impedance of a ferrite element 101 to that of air-filled waveguide arms 105. In alternative implementations, ferrite element 101 transitions to air-filled waveguide arm 105 without an aiding transformer. To transition directly, without an aiding transformer, from ferrite element 101 to air-filled waveguide arm 105, ferrite element 101 may be designed so that the impedance of ferrite element 101 matches the impedance of air-filled waveguide arm 105. For example, ferrite element 101 may be designed to be narrow as compared to corresponding ferrite elements 101 that are designed to interface with dielectric transformers 110. Further, the material that is used to fabricate ferrite element 101 is selected to have a particular saturation magnetization value, such that the impedance of ferrite element 101 matches the impedance of air filled waveguide arm 105.

In further embodiments, a dielectric spacer 102 is disposed on a surface of ferrite element 101 that is parallel to the H-plane. Dielectric spacer 102 is used to securely position ferrite element 101 in the housing and to provide a thermal path out of ferrite element 101 for high power applications. In some embodiments, a second dielectric spacer 113 would be used, located on a surface of ferrite element 101 that is opposite to the surface of ferrite element 101 in contact with dielectric spacer 102. The components described above are disposed within conductive waveguide circulator structure 100. Matching elements 104 are capacitive/inductive dielectric or metallic buttons used to empirically improve the impedance match between ferrite element 101 and waveguide arms 105 over a desired operating frequency band. Empirical matching elements 104 can be disposed on the surface of conductive waveguide circulator structure 100 to improve the impedance matching.

In some exemplary embodiments described in the present disclosure, the magnitude of impedance difference between the inner cavity 105 containing the ferrite element 101 and the air-filled waveguide arm 105 is reduced by narrowing the width between walls of air-filled waveguide arm 105 that are perpendicular to the H-plane through a tapered matching component 108. Tapered matching components 108 reduce the magnitude of impedance difference between the inner cavity 106 containing the ferrite element 101 and the waveguide arm 105. In some embodiments, tapered matching components 108 are coupled to waveguide arm 105 at wide taper end 103 and coupled to inner cavity 106 at narrow taper end 115. In certain embodiments, the width of a tapered matching component 108 is narrower at narrow taper end 115 than at wide taper end 103, where the width at wide taper end 103 is equal to the width of a waveguide arm 105. The width of the tapered impedance matching end 108 becomes narrower at the impedance matching end 115 to reduce the difference between the magnitude of impedance of the inner cavity 105 containing the ferrite element 101 and the tapered matching component 108 at the narrow taper end 115 and the impedance of the waveguide arm 105. As described above, the narrow taper end 115 of the tapered matching component 108 is proximate to the ferrite element 101 within the inner cavity 106. Further, in some embodiments, segments 111 of ferrite element 101 extend into the length of the tapered matching component 108 such that both the narrow taper end 115 and the wide taper end 103 are proximate ferrite element 101. After the fabrication of waveguide circulator 101, empirical matching elements 104 are placed on the surface of the conductive waveguide circulator structure 100 to more accurately match the impedance of the combination of the ferrite element 101 and tapered matching component to the impedance of waveguide arms 105. Further, narrowing the width of the waveguide in the region around ferrite element 101 reduces the magnitude of the impedance difference between the ferrite element 101 loaded inner cavity 106 region and the waveguide arms 105, thereby improving the frequency bandwidth achieved through the ferrite segments 111 and dielectric transformer 110 impedance matching sections.

Figure 3:
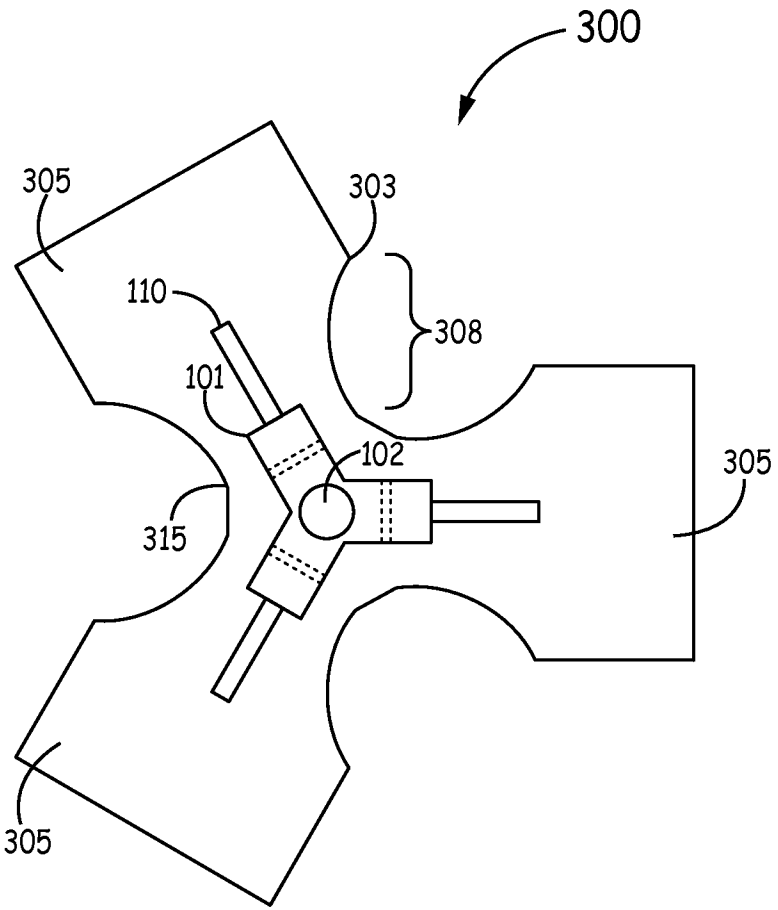
FIGS. 2-7 are block diagrams that illustrate alternative embodiments of a waveguide circulator.
Figure 2:
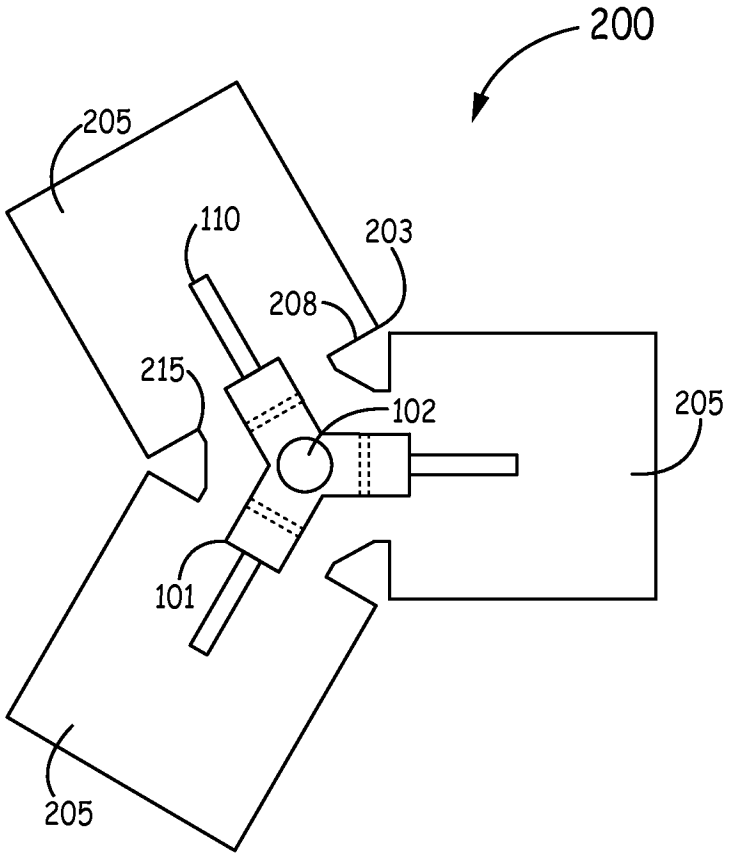

FIGS. 2-7 represent block diagrams illustrating different embodiments of a tapered matching component that matches the impedance between an inner cavity containing a ferrite element 101 and a waveguide arm. In particular, FIG. 2 represents a waveguide circulator 200 that includes a tapered matching component 208 that transitions from the width of a waveguide arm 205 at wide taper end 203 to the narrower width at narrow taper end 215 by stepping the sides of waveguide arms 205 towards the ferrite element 101. Beyond the tapered matching component, waveguide circulator 200 is generally similar to waveguide circulator 100 in FIG. 1. In particular, waveguide circulator 200 includes a ferrite element 101, dielectric transformers 110, a spacer 102, and waveguide arms 205, which are respectively similar to ferrite element 101, dielectric transformers 110, spacer 102, and waveguide arms 105 as described above in FIG. 1. As illustrated in FIG. 2, because the tapered matching component 208 changes in width by stepping from the width at wide taper end 203 to the width at narrow taper end 215, the tapered matching component 208 is entirely located proximate to ferrite element 101. FIG. 3 illustrates an alternative embodiment for a waveguide circulator 300 where the width of the tapered matching component 308 between wide taper end 303 and narrow taper end 315 constantly becomes narrower but the rate at which the tapered matching component 308 narrows decreases as the location along the tapered matching component 308 becomes closer to the narrow taper end 315. Thus, the tapered matching component 308 tapers through a curved surface between the wide taper end 303 and the narrow taper end 315. Otherwise, like waveguide circulator 200, waveguide circulator 300 is similar to waveguide circulator 100 in FIG. 1. In particular, waveguide circulator 300 includes a ferrite element 101, dielectric transformers 110, a spacer 102, and waveguide arms 305, which are respectively similar to ferrite element 101, dielectric transformers 110, spacer 102, and waveguide arms 105 as described above in FIG. 1.

Figure 4:
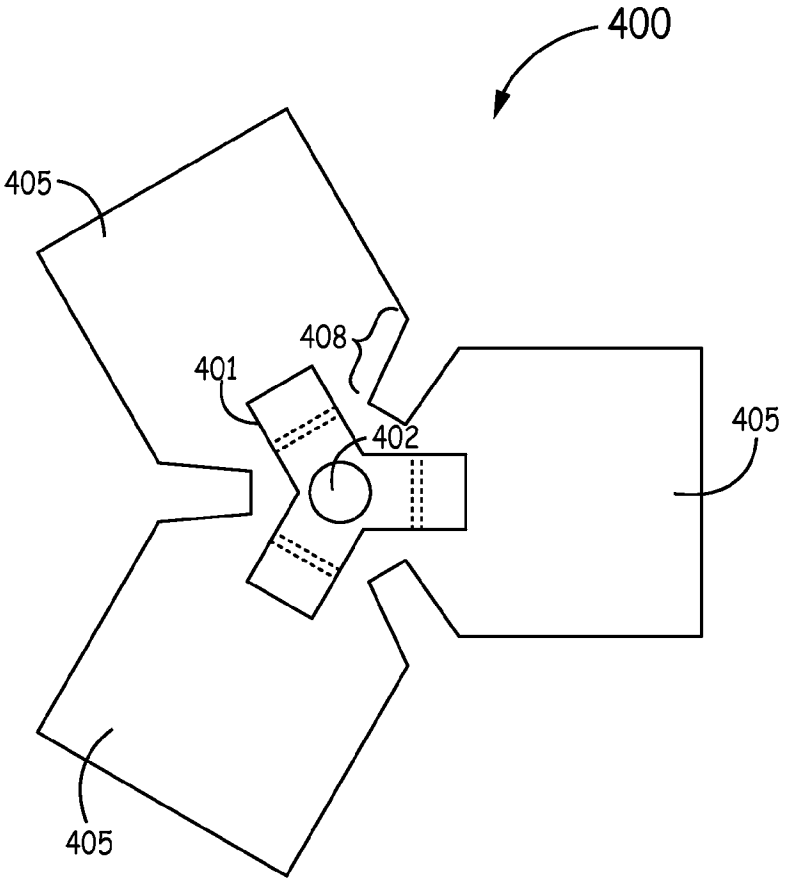

FIG. 4 represents a waveguide circulator 400 that is similar to waveguide circulator 100 in FIG. 1 with the exception that ferrite element 401 is impedance matched to waveguide arm 405 without the aid of dielectric transformers. Otherwise, waveguide circulator 400 includes a spacer 402, waveguide arms 405, and a tapered matching component 408 which are respectively similar to spacer 102, waveguide arms 105, and tapered matching component 108 as described above. Embodiments of waveguide circulator 400 that lack dielectric transformers may be used in applications that provide less space for waveguide circulator 400. Waveguide circulators that lack dielectric transformers are described in U.S. Pat. No. 7,242,263 entitled "TRANSFORMER-FREE WAVEGUIDE CIRCULATOR" filed on Aug. 18, 2005, herein incorporated in its entirety by reference and referred to herein as the '263 patent.

Figure 5:
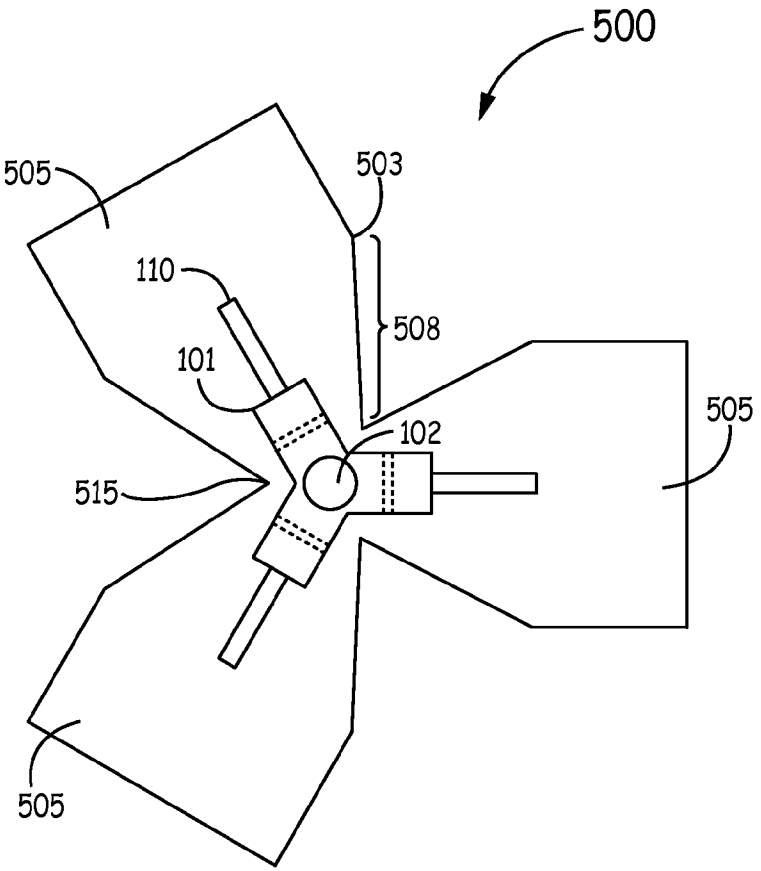

FIG. 5 illustrates an alternative embodiment for a waveguide circulator 500 where tapered matching components 508 connected to two adjacent waveguide arms 505 are contiguous. As shown in FIG. 1, the tapered matching components 108 on two adjacent waveguide arms 105 are connected through a flat region 117 that is approximately perpendicular to the longitudinal axis of the non-adjacent waveguide arm 105, where waveguide circulator 100 contains three waveguide arms 105. The flat region provides a single surface for the magnetic windings 135 to enter the waveguide circulator 100. As illustrated in FIG. 5, waveguide circulator 500 does not possess the flat surface between transition regions on adjacent waveguide arms 505. Otherwise, waveguide circulator 500 is similar to waveguide circulator 100. For example, waveguide circulator 500 includes a ferrite element 101, dielectric transformers 110, a spacer 102, and waveguide arms 505, which are respectively similar to ferrite element 101, dielectric transformers 110, spacer 102, and waveguide arms 105 as described above.

Figure 6:
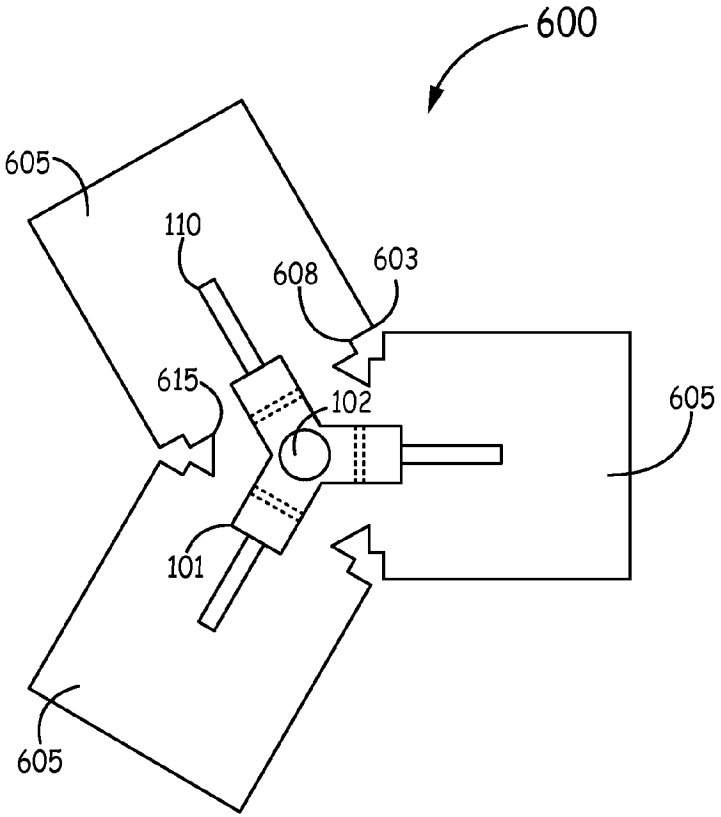

FIG. 6 represents a waveguide circulator 600 that includes a tapered matching component 608 that transitions from the width of a waveguide arm 605 at wide taper end 603 to the narrower width at narrow taper end 615 through a series of steps that narrow the sides of waveguide arms 105 towards the ferrite element 101. Beyond the tapered matching component, waveguide circulator 600 is generally similar to waveguide circulator 100 in FIG. 1. In particular, waveguide circulator 600 includes a ferrite element 101, dielectric transformers 110, a spacer 102, and waveguide arms 605, which are respectively similar to ferrite element 101, dielectric transformers 110, spacer 102, and waveguide arms 105 as described above in FIG. 1.

Figure 7:
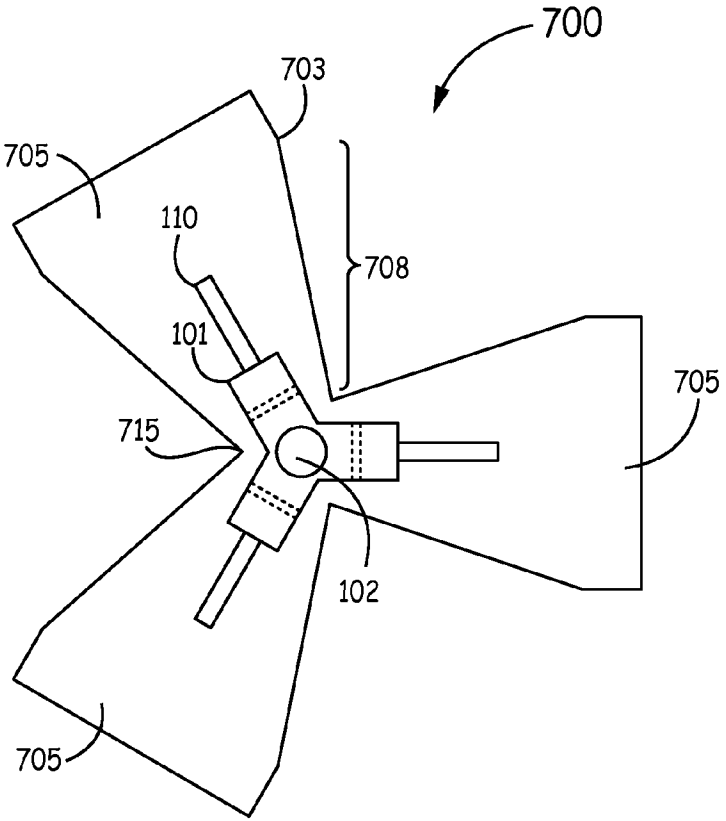

FIG. 7 illustrates an alternative embodiment for a waveguide circulator 700 where tapered matching components 708 connected to two adjacent waveguide arms 705 are contiguous. As shown in FIG. 1, the tapered matching components 108 on two adjacent waveguide arms 105 are connected through a flat region 117 that is approximately perpendicular to the longitudinal axis of the non-adjacent waveguide arm 105, where waveguide circulator 100 contains three waveguide arms 105. The flat region provides a single surface for the magnetic windings 135 to enter the waveguide circulator 100. As illustrated in FIG. 7, waveguide circulator 700 does not possess the flat surface between transition regions on adjacent waveguide arms 705. Further, the tapered matching components 708 extend beyond the ferrite element and dielectric transformers into the waveguide arms 705. Otherwise, waveguide circulator 700 is similar to waveguide circulator 100. For example, waveguide circulator 700 includes a ferrite element 101, dielectric transformers 110, a spacer 102, and waveguide arms 705, which are respectively similar to ferrite element 101, dielectric transformers 110, spacer 102, and waveguide arms 105 as described above.

Figure 8:
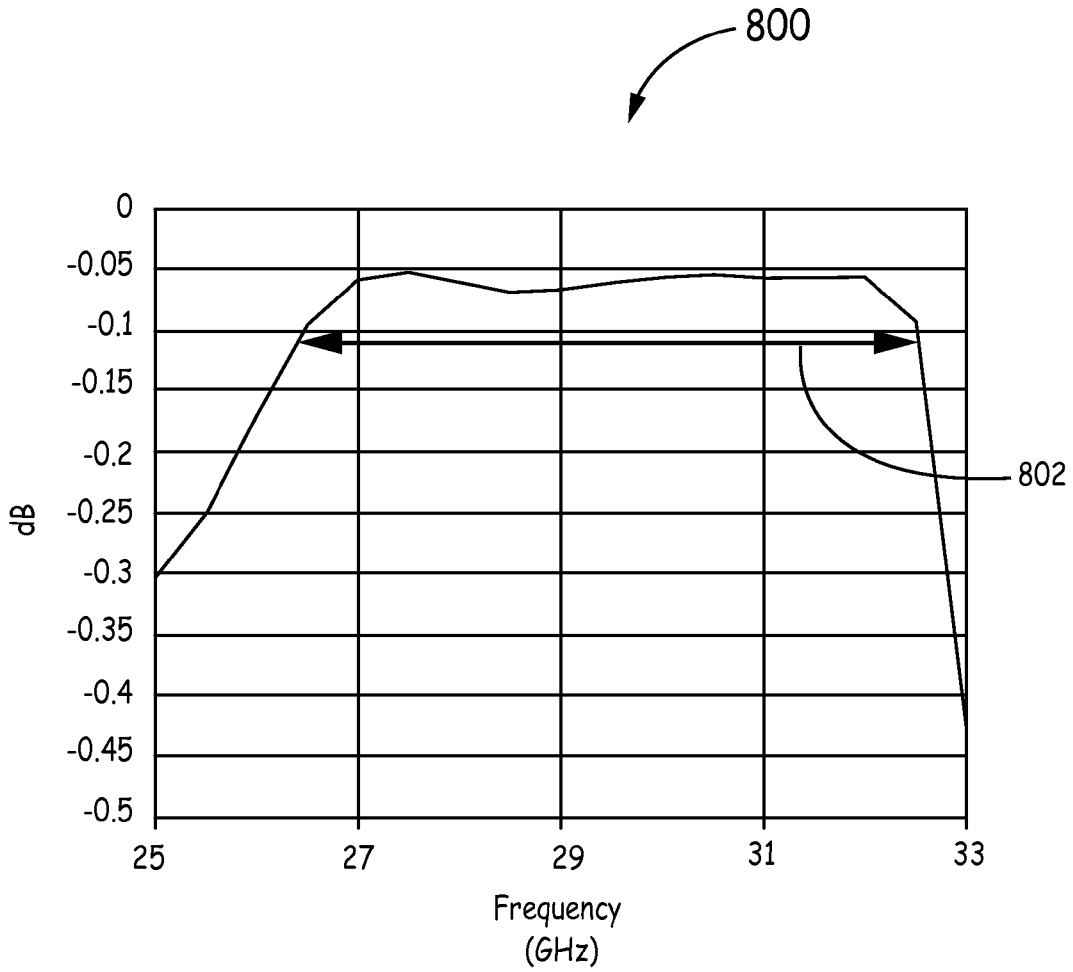
FIG. 8 is a graph of the insertion loss of a waveguide circulator according to one embodiment.
Figure 9:
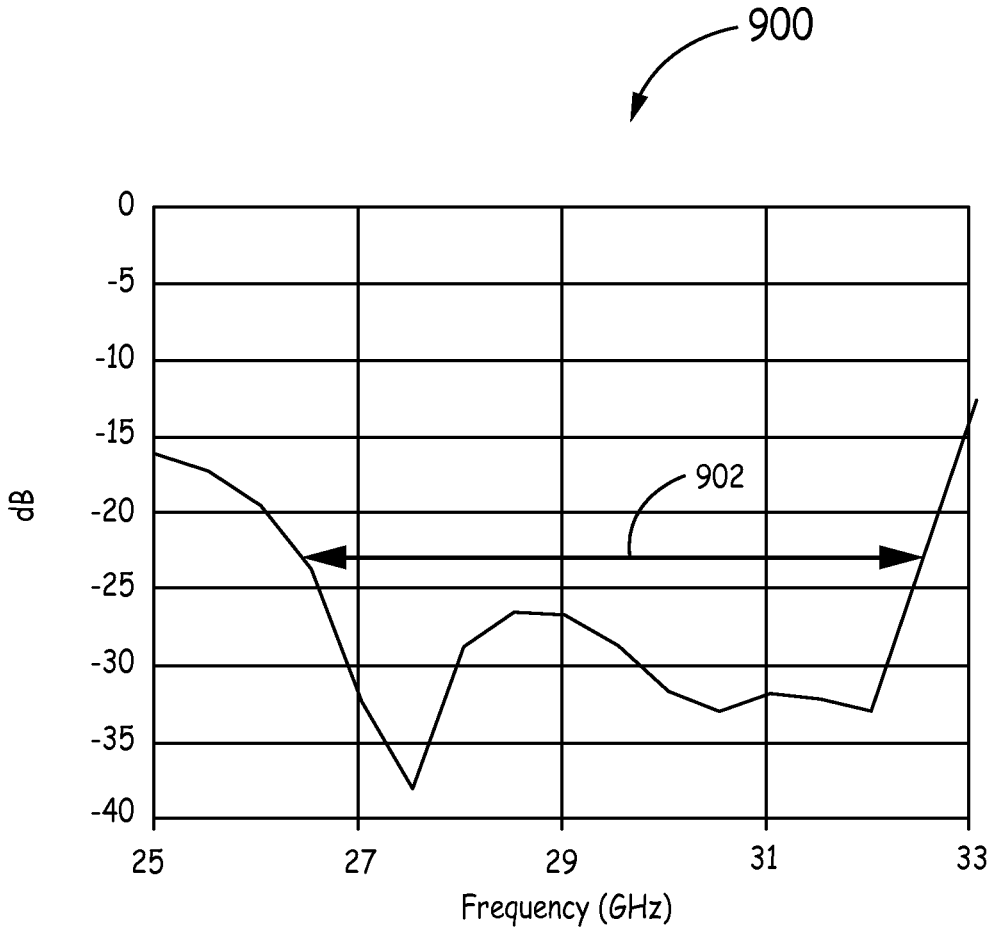
FIG. 9 is a graph of the isolation in a waveguide circulator according to one embodiment.
Figure 10:
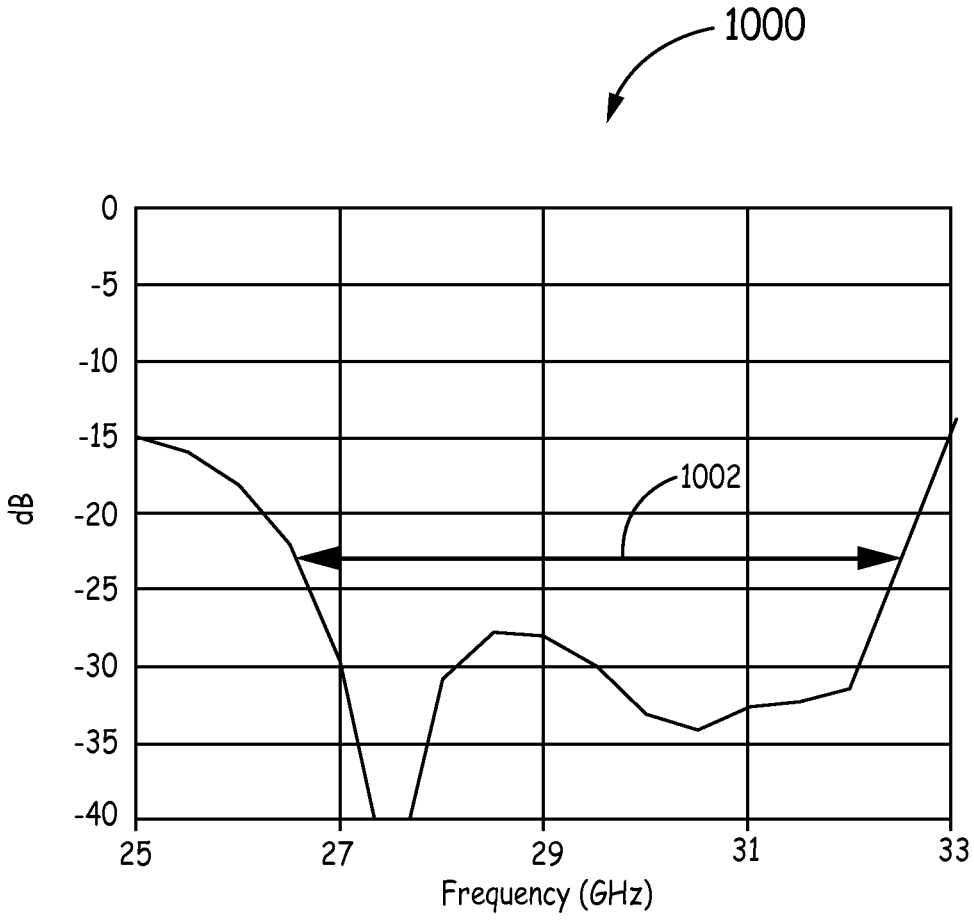
FIG. 10 is a graph of the return loss of a waveguide circulator according to one embodiment.

FIGS. 8-10 are graphs illustrating the bandwidth of different characteristics of one embodiment described by the present disclosure. For example, FIG. 8 is a graph 800 of the bandwidth 802 for the insertion loss for one embodiment described by the present disclosure. As shown in graph 800, the bandwidth 802 for an insertion loss of 0.12 dB or less is about 6 GHz. Further, FIG. 9 is a graph 900 of the isolation for one embodiment described by the present disclosure. As shown in graph 900, the bandwidth 902 for an isolation level of 23 dB or greater is about 6 GHz. Also, FIG. 10 is a graph 1000 of the return loss for one embodiment described by the present disclosure. As shown in graph 1000, the bandwidth 1002 for a return loss of 23 dB or greater is also about 6 GHz.

Figure 11:
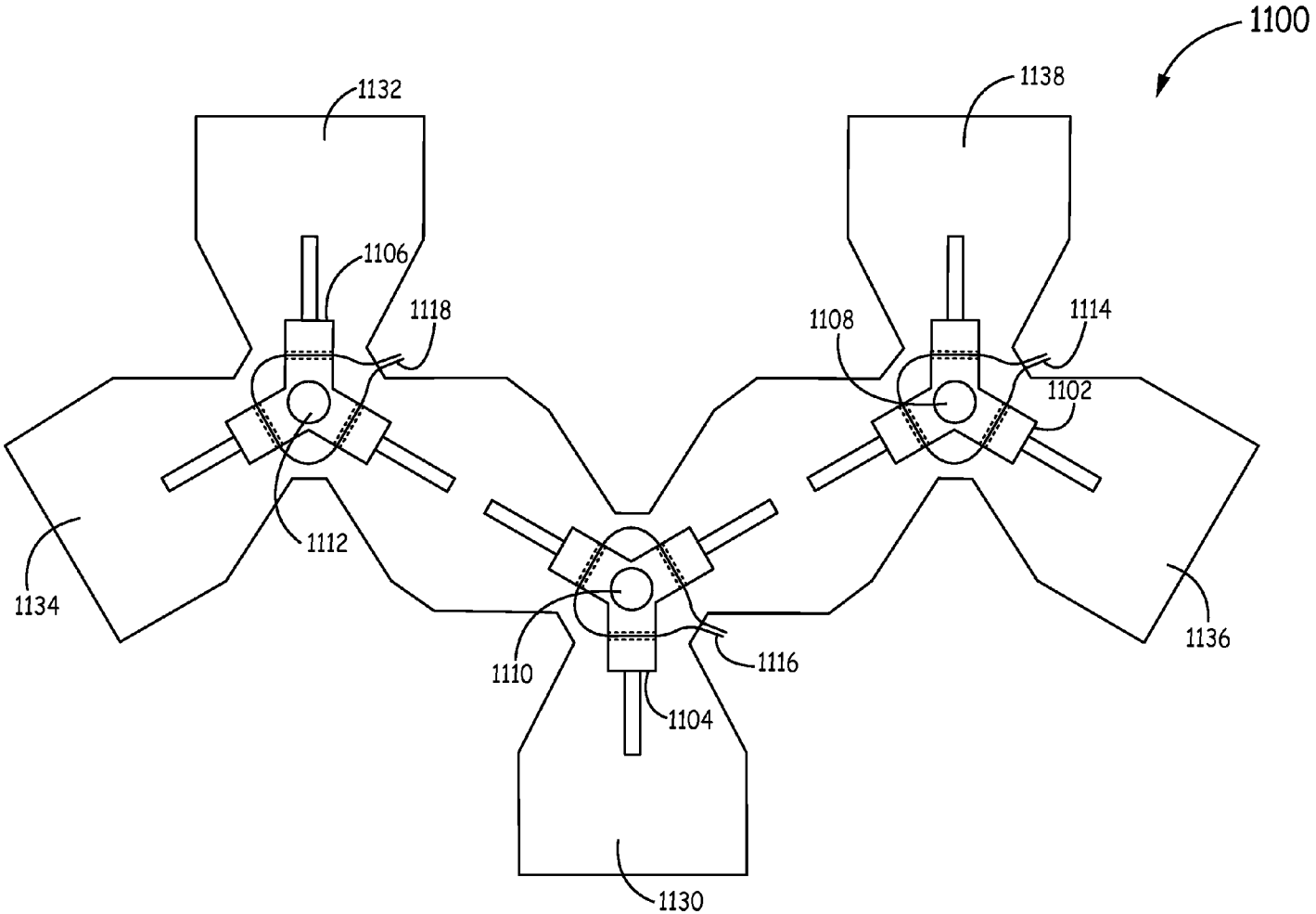
FIG. 11 is a block diagram illustrating a top view of a multi junction waveguide circulator according to one embodiment.

FIG. 11 is a diagram illustrating a top view of a multi junction waveguide circulator in accordance with a second embodiment of the invention. This circulator configuration is referred to as a single pole, four throw switch network (SP4T). An SP4T switch is comprised of three switching circulators and also referred to as a multi junction circulator with three ferrite junctions. It is important to note that while the described embodiments illustrate the ferrite element as having a Y-shape with three legs, the invention can also include use of ferrite elements having a variety of differing shapes, including a triangular puck. While these shapes may not be considered to have legs or protruding segments as described above, they nevertheless have a particularly protruding segment which operates in a manner similar to the segments described above FIG. 11 shows a conductive waveguide structure 1100 that includes three ferrite elements (also called toroids) 1102, 1104, and 1106 configured in a manner so that at least one leg of each ferrite element is adjacent to one leg of a neighboring ferrite element. Each ferrite element 1102, 1104, and 1106 has three segments and has dielectric spacers 1108, 1110, and 1112, respectively disposed on its outer surface. Apertures are bored through each segment of the ferrite element 1102 so that the magnetized winding 1114 can be threaded through each segment of the ferrite element 1102. Similarly, ferrite elements 1104 and 1106 have magnetic windings 1116 and 1118, respectively threaded through each segment. Alternatively, the magnetic windings are threaded through at least one of the ferrite element segments, but not necessarily all three.

All of the components described above are disposed within the conductive waveguide structure 1100, and as in the first embodiment, the conductive waveguide structure is generally air-filled. The conductive waveguide structure 1100 also includes waveguide input/output arms 1130, 1132, 1134, 1136, and 1138. Waveguide arms 1130, 1132, 1134, 1136, and 1138 provide interfaces for signal input and output.

One segment of each of ferrite element 1104 and two segments of ferrite elements 1102 and 1106 are impedance matched directly to the waveguide arms 1130, 1132, 1134, 1136, and 1138, respectively. The impedance matching is achieved through the design of the ferrite elements 1102, 1104, and 1106 and dielectric spacers 1108, 1110, and 1112. In certain embodiments, quarter wave transformers are used to aid in matching the impedance between the segments of ferrite elements 1102, 1104, and 1106 and the waveguide arms 1130, 1132, 1134, 1136, and 1138. Further, the widths of waveguide arms 1130, 1132, 1134, 1136, and 1138 pass through a tapered matching component that is proximate to each segment of each ferrite element 1102, 1104, and 1106, where the width of the tapered matching components narrow such that the difference between the impedance of the inner cavities loaded with ferrite elements 1102, 1104, and 1106 and the impedance of the waveguide arms 1130, 1132, 1134, 1136, and 1138 is reduced. As shown in FIG. 11, the adjacent segments of ferrite elements 1102 and 1104 have tapered matching components around adjacent segments. Similarly, the adjacent segments of ferrite elements 1104 and 1106 also have tapered matching components around adjacent segments.

In operation as an SP4T switch, an RF signal is provided as an input through waveguide arm 1130 and the RF signal is delivered as an output through one of the other waveguide arms 1132, 1134, 1136, and 1138. For example, the signal enters the waveguide structure 1100 after traveling through waveguide arm 1130 and is received by ferrite element 1104. Depending upon the magnetization of ferrite element 1104, the RF signal is directed toward either ferrite element 1102 or 1106. The direction of the RF signal propagating through ferrite element 1102, 1104, and 1106 can be described as clockwise or counter-clockwise with respect to the center of the ferrite element. For example, if the signal input through waveguide arm 1130 passes in a clockwise direction through ferrite element 1104, it will propagate in the direction of the ferrite element 1106. For this signal to continue through ferrite element 1106 towards arm 1132, the magnetization of ferrite element 1106 should be established so that the propagating signal passes in the counter-clockwise direction with respect to the center junction of ferrite element 1106. The RF signal will thereby exit through waveguide arm 1132 with low insertion loss. To change the low loss output port from output 1132 to a different output 1138, a magnetizing current is passed through magnetizing winding 1116 so as to cause circulation through ferrite element 1104 in the counterclockwise direction, and a magnetizing current is passed through magnetizing winding 1114 so as to cause circulation through ferrite element 1102 in the clockwise direction. This allows the RF signal to propagate from the input arm 1130 to the second output arm 1138 with low insertion loss (effectively ON) and from the input arm 1130 to the other output arms 1132, 1134, and 1136 with high insertion loss (effectively OFF). The tapered matching components around the ferrite elements, allow for the propagation of the RF signal from input arm 1130 to any of the output arms 1132, 1134, 1136, and 1138 with a reduced impedance difference between the inner cavities loaded with ferrite elements 1102, 1104, and 1106 and waveguide arms 1130, 1132, 1134, 1136, and 1138.

Figure 12:
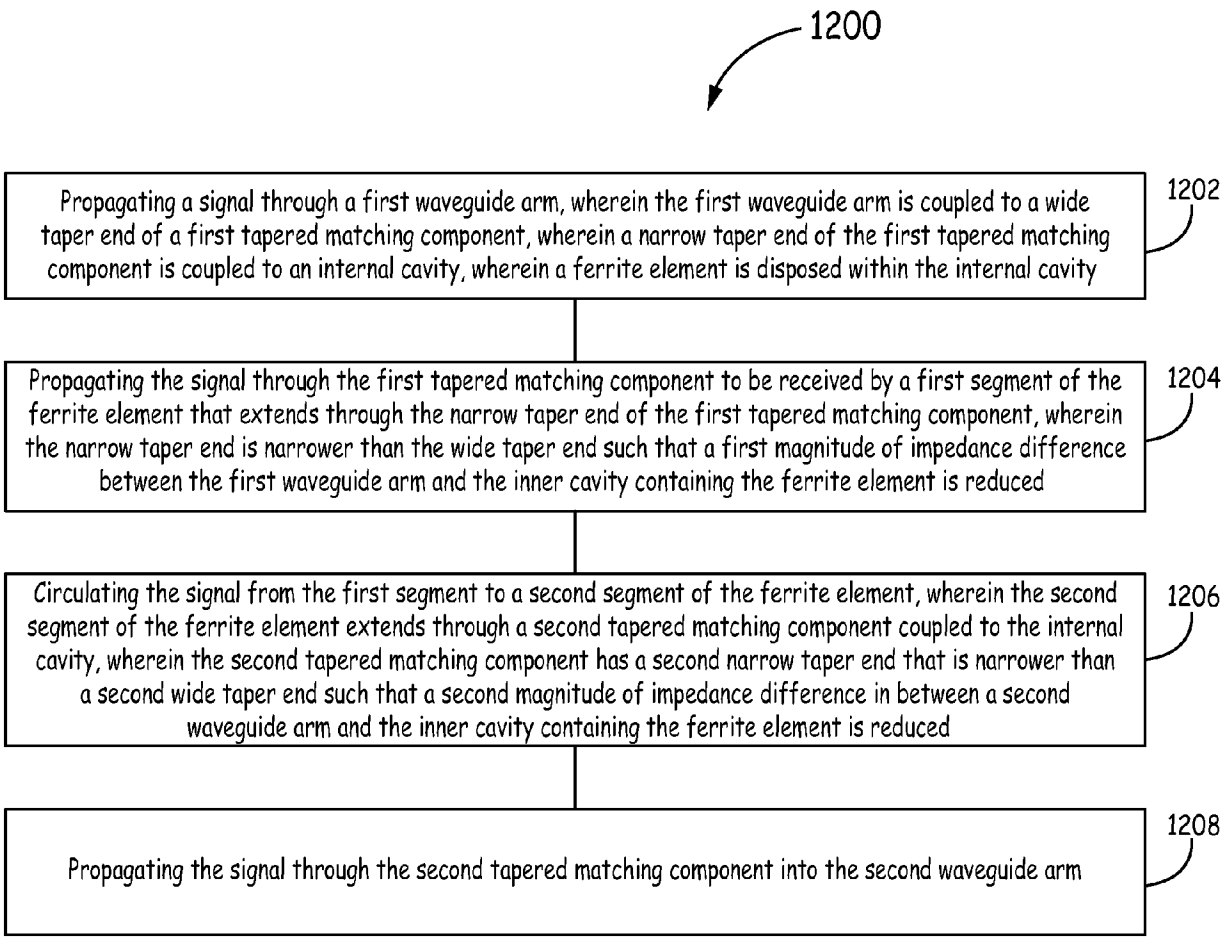
FIG. 12 is a flow diagram illustrating a method for impedance matching a waveguide circulator to a waveguide according to one embodiment.

FIG. 12 is a flow diagram illustrating a method 1200 for impedance matching a waveguide circulator to a waveguide. Method 1200 begins at 1202 with propagating a signal through a first waveguide arm, wherein the first waveguide arm is coupled to a wide taper end of a first tapered matching component, wherein a narrow taper end of the first tapered matching component is coupled to an internal cavity, wherein a ferrite element is disposed within the internal cavity. The method 1200 proceeds at 1204 with propagating the signal through the first tapered matching component to be received by a first segment of the ferrite element that extends through the narrow taper end of the first tapered matching component, wherein the narrow taper end is narrower than the wide taper end such that a first magnitude of impedance difference between the first waveguide arm and the inner cavity containing the ferrite element is reduced.

The method 1200 proceeds at 1206 with circulating the signal from the first segment to a second segment of the ferrite element, wherein the second segment of the ferrite element extends through a second tapered matching component coupled to the internal cavity, wherein the second tapered matching component has a second narrow taper end that is narrower than a second wide taper end such that a first magnitude of impedance difference between the first waveguide arm and the inner cavity containing the ferrite element is reduced. The method 1200 proceeds at 1208 with propagating the signal through the second tapered matching component into the second waveguide arm.

EXAMPLE EMBODIMENTS

Example 1 includes a waveguide circulator, comprising a waveguide structure, the waveguide structure including a plurality of waveguide arms extending from a waveguide arm junction, wherein the plurality of arms connect to the waveguide arm junction at a plurality of tapered matching components, wherein each tapered matching component in the plurality of tapered matching components has a narrow taper end that is proximate to the waveguide arm junction and a wide taper end that is distal to waveguide arm junction, wherein the width of the narrow taper end is narrower along an H-plane for the waveguide structure than the wide taper end; and a ferrite element disposed in the waveguide arm junction and having a plurality of segments matching the number of waveguide arms, wherein each segment in the plurality of segments extends through the narrow taper end of the tapered matching component and the width of the narrow taper end of the tapered matching component is narrower than the wide taper end such that a magnitude of impedance difference between each waveguide arm and the waveguide arm junction containing the ferrite element is reduced.

Example 2 includes the waveguide circulator of Example 1, comprising an aperture formed through each segment in the plurality of segments; and a magnetizing winding inserted through the apertures such that current applied to the magnetizing winding establishes a magnetic field in the ferrite element.

Example 3 includes the waveguide circulator of Example 2, wherein the magnetic winding enters the waveguide structure at a region between two tapered matching components in the plurality of tapered matching components of two adjacent waveguide arms.

Example 4 includes the waveguide circulator of any of Examples 1-3, wherein the ferrite element comprises a quarter wave dielectric transformer formed on the end of each segment in the plurality of segments that extends into the waveguide arms.

Example 5 includes the waveguide circulator of any of Examples 1-4, comprising at least one empirical impedance matching element placed within the waveguide structure.

Example 6 includes the waveguide circulator of any of Examples 1-5, comprising at least one spacer, the at least one spacer positioning the ferrite element within the waveguide arm junction.

Example 7 includes the waveguide circulator of any of Examples 1-6, wherein the ferrite element is y-shaped.

Example 8 includes the waveguide circulator of any of Examples 1-7, wherein the width of the tapered matching component is reduced through at least one of a linear decrease in width over the length of the tapered matching component; a stepped decrease in width through the tapered matching component; and a curved decrease in width over the length of the tapered matching component.

Example 9 includes a waveguide structure, comprising a plurality of waveguide arms; an internal cavity; a plurality of tapered matching components, wherein each tapered matching component in the plurality of tapered matching components has a narrow taper end that is connected to the internal cavity and a wide taper end that is connected to a waveguide arm in the plurality of waveguide arms, wherein the narrow taper end is narrower than the wide taper end; and a ferrite element having a plurality of ferrite element segments disposed in the internal cavity, wherein a segment in the plurality of ferrite element segments extends through the narrow taper end of the tapered matching component and the narrow taper end of the tapered matching component is narrower than the wide taper end such that a magnitude of impedance difference between each waveguide arm and the internal cavity containing the ferrite element is reduced.

Example 10 includes the waveguide structure of Example 9, comprising an aperture formed through each ferrite element segment in the plurality of ferrite element segments; and a magnetizing winding inserted through the apertures such that current applied to the magnetizing winding establishes a magnetic field in the ferrite element.

Example 11 includes the waveguide structure of any of Examples 9-10, wherein the magnetizing winding enters the internal cavity of the waveguide structure at a region between two tapered matching components in the plurality of tapered matching components of two adjacent waveguide arms.

Example 12 includes the waveguide structure of any of Examples 9-11, comprising a quarter wave dielectric transformer formed on the end of each segment in the plurality of segments.

Example 13 includes the waveguide structure of any of Examples 9-12, comprising at least one empirical impedance matching element placed within the waveguide structure.

Example 14 includes the waveguide structure of any of Examples 9-13, comprising at least one spacer, the at least one spacer positioning the ferrite element within the internal cavity.

Example 15 includes the waveguide structure of any of Examples 9-14, wherein the ferrite element is y-shaped.

Example 16 includes the waveguide structure of any of Examples 9-15, wherein the width of the tapered matching component is reduced through at least one of a linear decrease in width over the length of the tapered matching component; a stepped decrease in width through the tapered matching component; and a curved decrease in width over the length of the tapered matching component.

Example 17 includes the waveguide structure of any of Examples 9-16, further comprising a second ferrite element disposed in the internal cavity.

Example 18 includes a method for circulating a signal in a waveguide circulator, the method comprising propagating a signal through a first waveguide arm, wherein the first waveguide arm is coupled to a wide taper end of a first tapered matching component, wherein a narrow taper end of the first tapered matching component is coupled to an internal cavity, wherein a ferrite element is disposed within the internal cavity; propagating the signal through the first tapered matching component to be received by a first segment of the ferrite element that extends through the narrow taper end of the first tapered matching component, wherein the narrow taper end is narrower than the wide taper end such that a first magnitude of impedance difference between the first waveguide arm and the inner cavity containing the ferrite element is reduced; circulating the signal from the first segment to a second segment of the ferrite element, wherein the second segment of the ferrite element extends through a second tapered matching component coupled to the internal cavity, wherein the second tapered matching component has a second narrow taper end that is narrower than a second wide taper end such that a second magnitude of impedance difference in between a second waveguide arm and the inner cavity containing the ferrite element is reduced; and propagating the signal through the second tapered matching component into the second waveguide arm.

Example 19 includes the method of Example 18, wherein circulating the signal further comprises establishing a magnetic field in the ferrite element.

Example 20 includes the method of Example 19, wherein the establishing the magnetic field comprises conducting a current through a magnetizing winding that extends through each segment in the ferrite element.

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

What is claimed is:

1. A waveguide circulator, comprising:

a plurality of waveguide structures, each waveguide structure in the plurality of waveguide structures including a plurality of waveguide arms extending from a waveguide arm junction, wherein the plurality of arms connect to the waveguide arm junction at a plurality of tapered matching components, wherein each tapered matching component in the plurality of tapered matching components has a narrow taper end that is proximate to the waveguide arm junction and a wide taper end that is distal to waveguide arm junction, wherein the width of the narrow taper end is narrower along an H-plane for the waveguide structure than the wide taper end; and a plurality of ferrite elements, each ferrite element in the plurality of ferrite elements disposed in a respective waveguide arm junction in a respective waveguide structure in the plurality of waveguide structures, the ferrite element having a plurality of segments matching the number of waveguide arms, wherein each segment in the plurality of segments extends through the narrow taper end of an associated tapered matching component in the plurality of tapered matching components and the width of the narrow taper end of the associated tapered matching component is narrower than the wide taper end such that a magnitude of impedance difference between each waveguide arm and the waveguide arm junction containing the ferrite element is reduced, wherein the impedance of the waveguide arm is the impedance of a waveguide that conveys microwave energy to and from the ferrite element.

2. The waveguide circulator of claim 1, wherein the ferrite element comprises a quarter wave dielectric transformer formed on the end of each segment in the plurality of segments that extends into the waveguide arms.

3. The waveguide circulator of claim 1, comprising at least one empirical impedance matching element placed within the waveguide structure.

4. The waveguide circulator of claim 1, comprising at least one spacer, the at least one spacer positioning the ferrite element within the waveguide arm junction.

5. The waveguide circulator of claim 1, wherein the ferrite element is y-shaped.

6. The waveguide circulator of claim 1, wherein the width of the tapered matching component is reduced through at least one of:

a linear decrease in width over the length of the tapered matching component;

a stepped decrease in width through the tapered matching component; and a curved decrease in width over the length of the tapered matching component.

7. The waveguide circulator of claim 1, comprising:

an aperture formed through each segment in the plurality of segments; and a magnetizing winding inserted through the apertures such that current applied to the magnetizing winding establishes a magnetic field in the ferrite element.

8. The waveguide circulator of claim 7, wherein the magnetic winding enters the waveguide structure at a region between two tapered matching components in the plurality of tapered matching components of two adjacent waveguide arms.

9. A waveguide structure, comprising a plurality of waveguide arms;

at least one internal cavity;

a plurality of tapered matching components, wherein each tapered matching component in the plurality of tapered matching components has a narrow taper end that is connected to the at least one internal cavity and a wide taper end that is connected to a waveguide arm in the plurality of waveguide arms, wherein the narrow taper end is narrower than the wide taper end; and a plurality of ferrite elements, each ferrite element in the plurality of ferrite elements having a plurality of ferrite element segments disposed in the at least one internal cavity, wherein each segment in the plurality of ferrite element segments extends through the narrow taper end of an associated tapered matching component in the plurality of tapered matching components and the narrow taper end of the associated tapered matching component is narrower than the wide taper end such that a magnitude of impedance difference between each waveguide arm and the at least one internal cavity containing the ferrite element is reduced, wherein the impedance of the waveguide arm is the impedance of a waveguide that conveys microwave energy to and from the ferrite element.

10. The waveguide structure of claim 9, comprising:

an aperture formed through each ferrite element segment in the plurality of ferrite element segments; and a magnetizing winding inserted through the apertures such that current applied to the magnetizing winding establishes a magnetic field in the ferrite element.

11. The waveguide structure of claim 9, wherein the magnetizing winding enters the at least one internal cavity of the waveguide structure at a region between two tapered matching components in the plurality of tapered matching components of two adjacent waveguide arms.

12. The waveguide structure of claim 9, comprising a quarter wave dielectric transformer formed on the end of each segment in the plurality of segments.

13. The waveguide structure of claim 9, comprising at least one empirical impedance matching element placed within the waveguide structure.

14. The waveguide structure of claim 9, comprising at least one spacer, the at least one spacer positioning the plurality of ferrite element within the at least one internal cavity.

15. The waveguide structure of claim 9, wherein the ferrite element is y-shaped.

16. The waveguide structure of claim 9, wherein the width of the tapered matching component is reduced through at least one of:

a linear decrease in width over the length of the tapered matching component;

a stepped decrease in width through the tapered matching component; and a curved decrease in width over the length of the tapered matching component.

17. A method for circulating a signal in a waveguide circulator, the method comprising:

propagating a signal through a first waveguide arm, wherein the first waveguide arm is coupled to a first wide taper end of a first tapered matching component, wherein a first narrow taper end of the first tapered matching component is coupled to an first internal cavity, wherein a first ferrite element is disposed within the first internal cavity;

propagating the signal through the first tapered matching component to be received by a first segment of the first ferrite element that extends through the first narrow taper end of the first tapered matching component, wherein the first narrow taper end is narrower than the first wide taper end such that a first magnitude of impedance difference between the first waveguide arm and the inner cavity containing the first ferrite element is reduced;

circulating the signal from the first segment to a second segment of the first ferrite element, wherein the second segment of the first ferrite element extends through a second tapered matching component coupled to the internal cavity, wherein the second tapered matching component has a second narrow taper end that is narrower than a second wide taper end such that a second magnitude of impedance difference in between a second waveguide arm and the inner cavity containing the first ferrite element is reduced, wherein the impedance of the second waveguide arm matches the impedance of a waveguide that conveys microwave energy to and from the ferrite element; and propagating the signal through the second tapered matching component into the second waveguide arm, wherein the second waveguide arm is coupled to a third wide taper end of a third tapered matching component, wherein a third narrow taper end of the third tapered matching component is coupled to a second internal cavity, wherein a second ferrite element is disposed within the second internal cavity and the second ferrite element is adjacent the first ferrite element.

18. The method of claim 17, wherein circulating the signal further comprises establishing a magnetic field in the first ferrite element.

19. The method of claim 18, wherein the establishing the magnetic field comprises conducting a current through a magnetizing winding that extends through each segment in the first ferrite element.

* * * * *